United States Patent [19]

Wendt et al.

[11] 4,157,016

[45] Jun. 5, 1979

[54] CRYOGENIC BEACH CLEANER

[76] Inventors: Robert F. Wendt, 2649 Mason St., Madison, Wis. 53705; Jan R. Acker, 4402 Dwight Dr., #B, Madison, Wis. 53701; Norman R. Braton, 457 Agnes Dr., Madison, Wis. 53711

[21] Appl. No.: 806,829

[22] Filed: Jun. 15, 1977

Related U.S. Application Data

[62] Division of Ser. No. 576,687, May 12, 1975, Pat. No. 4,043,140.

[51] Int. Cl.[2] ..... B01D 9/04

[52] U.S. Cl. ..... 62/123; 62/239; 15/93 R; 134/105; 405/130

[58] Field of Search ..... 62/62, 64, 123, 514 R, 62/532, 533, 534, 239; 171/63; 210/91, 242, DIG. 25; 61/36 A; 134/105; 15/93 R

[56] References Cited

U.S. PATENT DOCUMENTS

| | | | |
|---|---|---|---|
| 2,650,556 | 9/1953 | Turner | 111/7 |
| 3,410,065 | 11/1968 | Martin | 62/64 |
| 3,596,717 | 8/1971 | Knudsen | 171/63 |
| 3,614,873 | 10/1971 | Cole et al. | 62/66 |

*Primary Examiner*—Ronald C. Capossela
*Attorney, Agent, or Firm*—Gerald S. Geren

[57] ABSTRACT

A method and machine are disclosed herein for cleaning and restoring sand beaches which have become contaminated by oil spills. The machine travels on the beach and sprays liquid nitrogen onto the contaminated area, thereby solidifying the oil and sand mixture so that the mixture can be separated from the underlying uncontaminated sand and be efficiently removed from the beach and transported to a remote site for disposal or further treatment.

8 Claims, 3 Drawing Figures

FIG. 1
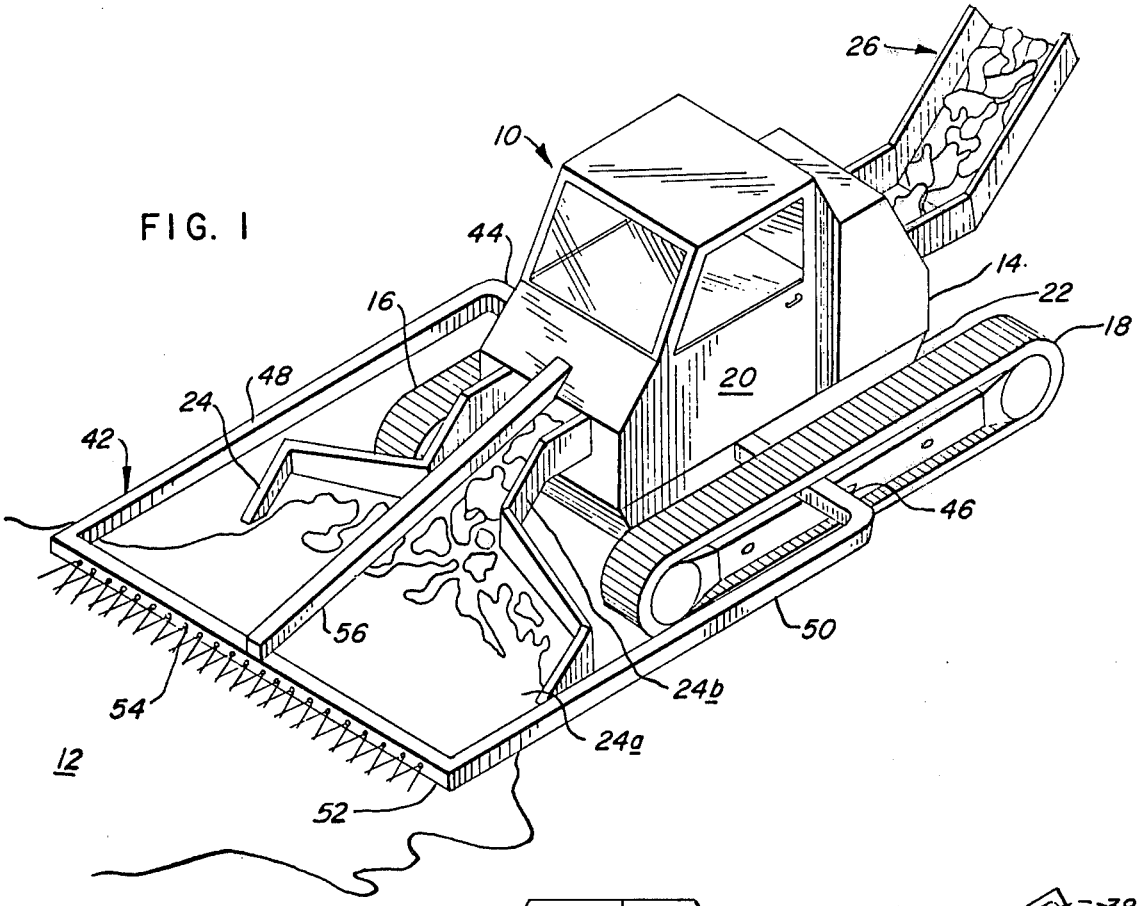
FIG. 2
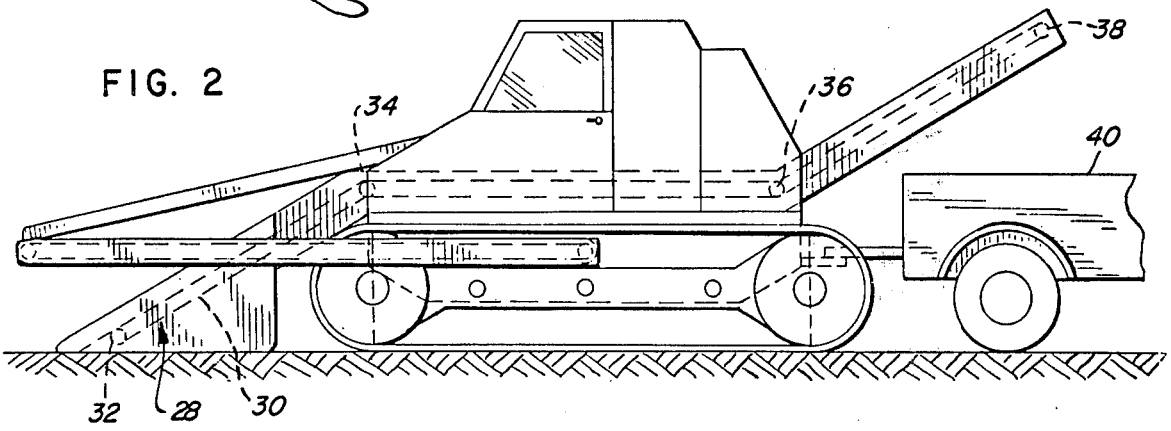
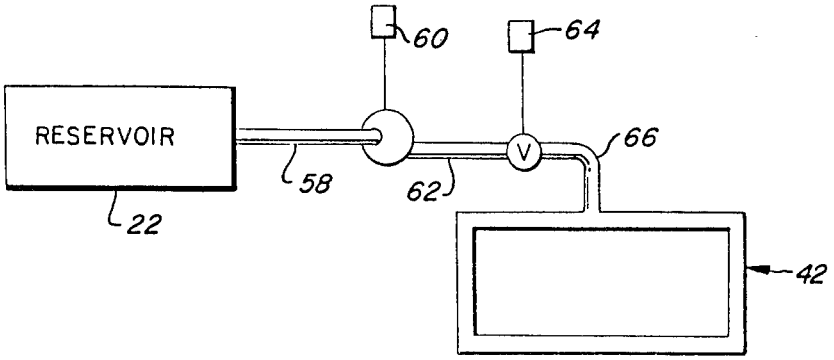
FIG. 3

CRYOGENIC BEACH CLEANER

This is a division, of application Ser. No. 576,687, filed May 12, 1975 now U.S. Pat. No. 4,043,140.

BACKGROUND OF THE INVENTION

This invention relates to a method and machine for cleaning sandy beaches which have been contaminated by an oil spill; and more particularly, to the use of liquid nitrogen in such a method and machine.

Ecological damage to beaches from oil spills presents a serious problem to people and water fowl, and it is desirable to restore the beaches to their pre-spill condition as promptly and as efficiently as possible. Heretofore much concentration and effort have been directed toward the solution of handling an oil spill on a water surface, but unfortunately, little effort has been directed toward the handling of the contaminated shoreline.

In the past if the penetration of the oil into the sand was comparatively shallow and the oil was not too fluid the contaminated area has been manually raked into windrows, which were subsequently manually shoveled into a front-end loader or dump truck. If the penetration was comparatively deep, mechanical scrapers and bulldozers have been required to remove the contaminated area. Furthermore, if oil was still washing ashore, a series of deep pits or trenches were dug along the shoreline to catch incoming oil. The oil in the trenches has then been removed by a vacuum tank truck. All of these techniques have been expensive, time-consuming and inefficient.

Another technique for oil removal has been to burn off the oil, but this requires rigid control of the oil fire and the smoke pollutes the atmosphere. Still another prior art method included pouring dispersants and emulsifiers onto the oil spill, but unfortunately, this causes penetration of the oil dispersant/emulsifier mixture into the sand to a depth of at least three times as great as the penetration depth of the untreated oil.

It is, therefore, an object of this invention to provide an efficient and ecologically unharmful method and associated equipment for restoring sandy beaches which have been contaminated by an oil spill.

This and other objects of this invention will become apparent from the following description and appended claims.

SUMMARY OF THE INVENTION

There is provided by this invention a method and machine for efficiently and effectively removing the oil contaminated area from a sandy beach in an ecologically desirable manner and transporting the contaminated materials to a disposal or treatment site. The method and machines eliminate the problems heretofore encountered in cleaning the beaches.

The method of this invention includes spraying liquid nitrogen onto the contaminated area so as to solidify the oil and sand into a mixture which can be easily separated from the clean underlying sand. A cryogenic beach-cleaning apparatus or vehicle is provided which includes a spray-head positioned forwardly of the vehicle for spraying the contaminated area and shovel means for separating the solidified mixture from the underlying sand. Conveyors transport the separated mixture from the shovel means and deliver it to trailers or trucks which are used to transport the mixture to a treatment or disposal site.

BRIEF DESCRIPTION OF THE DRAWINGS

FIG. 1 is a perspective view of a cryogenic beach-cleaning vehicle made in accordance with the present invention;

FIG. 2 is a side view of the beach cleaner with a portion of a trailer hitched to the rear end of the cleaner; and FIG. 3 is a schematic diagram of a fluid circuit for the cryogenic beach cleaner for handling a liquid cryogen.

DESCRIPTION OF THE PREFERRED EMBODIMENT

Referring now to the drawings, there is shown a cryogenic beach-cleaning vehicle 10 generally, shown moving toward an area 12 of a sandy beach which has been contaminated by an oil spill. The beach cleaner is a tracked vehicle which includes a body portion 14 generally, that is carried on a pair of endless tracks 16 and 18. The body includes a cab positioned at the forward end of the vehicle and a liquid nitrogen reservoir 22 on the underside of the body and beneath the cab. A shovel or scoop 24 is mounted on the body at the front end and extends forwardly of the tracks 16 and 18. The leading edges of the scoop define a wide-mouthed portion **24*a* for directing contaminated sand rearwardly toward the narrow or throat portion 24*b* adjacent the body 14**.

A discharge chute 26 is mounted on the body at the rearward end and extends in a generally rearward and upward direction therefrom. The terminus for the discharge chute is rearward of the back edge of the tracks 16 and 18.

A conveyor 28 generally, extends from the scoop through the body and to the discharge chute for delivering the contaminated sand from the scoop to the discharge end. The conveyor includes a belt 30 which is trained about: a forward roller 32 that is mounted laterally across the scoop near the mouth; a first intermediate roller 34, that is mounted to the body of the vehicle adjacent the discharge end of the scoop; a second intermediate roller 36, which is mounted on the body adjacent the inlet end of the discharge chute 26; and a discharge end roller 38 at the discharge end of the discharge chute 26. A trailer 40 is hitched to the rear end of a vehicle and receives contaminated material discharged from the chute 26.

The liquid nitrogen sprayer 42 generally, is connected to the liquid nitrogen reservoir 22. The sprayer is a box-like framework of hollow piping which includes the conduit sections 44 and 46, each of which connects at its inner end to the reservoir 22 and extends laterally outwardly from the reservoir through one of the endless tracks and terminates outwardly of the endless track. Side conduit sections 48 and 50 are each connected at one end to a lateral conduit section and extend forwardly therefrom to a position forward of the scoop 24. The spray-head 52 is connected at each end to one of the side conduit members 48 and 50 and includes a plurality of spray apertures, such as 54, for spraying liquid nitrogen in a forward direction. A boom 56 is connected at one end to the spray-head 58 and at the other end to the body 14 for supporting the sprayer and for controllably raising and lowering the sprayer.

The liquid nitrogen system includes the reservoir 22, which is connected through a line 58 to a pump 60. The discharge from the pump 60 passes through line 62 to a control valve 64 and then through a line 66 to the sprayer 42.

Liquid nitrogen is particularly advantageous as the liquid cryogen since it is available in commercial quantities, and after spraying it merely evaporates into the atmosphere with no ecological damage. However, it will be appreciated that other gases which are liquid at less than −100 degrees C. can be used.

In operation, as the vehicle moves forwardly into the contaminated area 12, the liquid nitrogen is sprayed onto that area. This spray causes the oil and sand mixture in the contaminated area to solidify, and the scoop is then able to lift and readily separate the solidified mixture from the uncontaminated dry sand which will not solidify. The solidified mixture is then directed by the scoop onto the conveyor 28, which moves the contaminated material up through the throat of the scoop **24*b*, through the body along the conveyor and out the discharge end 26 into a trailer 40**.

The contaminated material collected in the trailer can then be taken to a separation point where the oil can be separated from the sand and the oil returned to a refinery for further processing and the sand returned to the beach for restoration of the beach.

Controls for the vehicle, the raising and lowering of the spray-head, the conveyor, and the liquid nitrogen pump and valve are all provided for the operator within the cab 20. Standard control mechanisms and linkages are known to those in the art.

It will be appreciated that numerous changes and modifications can be made to this apparatus without departing from the spirit and scope of this invention.

What is claimed and is desired to be secured by Letters Patent of the United States is:

1. A cryogenic beach cleaning machine for cleaning a sandy beach which has been contaminated by oil from an oil spill mixing with the beach sand, which comprises:

means for moving said machine along said beach;

means for contacting at least a portion of the contaminated area with a liquid cryogen so as to solidify the mixture in the contacted area extending forwardly from said machine; and means for separating the solidified mixture from the remainder of the beach extending forwardly from said machine, said separation means positioned in trailing relation to said contacting means.

2. A cryogenic beach cleaning machine as in claim 1 further comprising means for conveying the separated material from the separation means to a discharge point for collection and removal.

3. A cryogenic beach cleaner as in claim 1 further comprising:

means defining a liquid cryogen reservoir for storage of the liquid cryogen; and conduit means connected to said contacting means and said reservoir for directing the liquid cryogen from said reservoir to said contacting means.

4. A cryogenic beach cleaner as in claim 3, wherein said contacting means is spray means.

5. A cryogenic beach cleaner as in claim 4, wherein said contacting means includes a frame which extends laterally outwardly of said cleaner and forwardly thereof and wherein said spray means is positioned at the forward end of said frame, so that said frame is wider than said vehicle and extends forwardly thereof.

6. A cryogenic beach cleaning machine for cleaning a sandy beach which has been contaminated by oil from an oil spill mixing with the beach sand, which comprises:

means for moving said machine along said beach;

means for contacting at least a portion of the contaminated area with a liquid cryogen so as to solidify the mixture in the contacted areas;

means for separating the solidified mixture from the remainder of the beach, said separation means positioned in trailing relation to said contacting means;

means defining a liquid cryogen reservoir for storage of the liquid cryogen;

conduit means connected to said contacting means and said reservoir for directing the liquid cryogen from said reservoir to said contacting means; and wherein said contacting means includes a frame which extends laterally outwardly of said cleaner and forwardly thereof and spray means is positioned at the forward end of said frame, so that said frame is wider than said vehicle and extends forwardly thereof; and said separating means includes means defining a scoop carried on said cleaner and extending forwardly of the cleaner, said scoop having a wide-mouth inlet portion for receiving solidified contaminated material, said mouth being positioned forwardly of said cleaner and rearwardly of said cryogenic spray means so that when said cleaner is moving forwardly said mouth is in trailing relation to the spray means.

7. A cryogenic beach cleaner as in claim 6, wherein the mouth of said scoop is narrower than the width of said cryogenic frame.

8. A cryogenic beach cleaner as in claim 7 further comprising:

discharge chute means at the rearward end of the cleaner for discharging the separated solidified mixture; and conveyor means for moving said material from said scoop to said discharge chute.

* * * * *